United States Patent [19]

Lauvray et al.

[11] Patent Number: 4,533,945

[45] Date of Patent: Aug. 6, 1985

[54] PROCESS AND ARRANGEMENT FOR AERIAL OBSERVATION AND/OR COMMUNICATION FOR A SUBMERGED SUBMARINE

[75] Inventors: Georges R. P. L. Lauvray, Versailles; Michel J. P. Darche, Ville d'Avray, both of France

[73] Assignee: Societe ECA, France

[21] Appl. No.: 450,673

[22] Filed: Dec. 17, 1982

[30] Foreign Application Priority Data

Dec. 22, 1981 [FR] France ..... 81 23958

[51] Int. Cl.[3] ..... H04N 7/18

[52] U.S. Cl. ..... 358/109; 358/87; 358/103; 340/850

[58] Field of Search ..... 358/103, 108, 109, 229, 358/87; 340/850; 455/617, 604

[56] References Cited

U.S. PATENT DOCUMENTS 3,258,595 6/1966 Galante ..... 358/108

*Primary Examiner*—Howard W. Britton

*Assistant Examiner*—Edward L. Coles

*Attorney, Agent, or Firm*—McGlew and Tuttle

[57] ABSTRACT

The invention relates to a process and an arrangement for aerial observation and/or communication for a submerged submarine. An apparatus (6) equipped with a television camera (15) or with a radio or radar antenna, and connected to the submarine by a cable (8), is initially accommodated in a tube (3) on board the submarine. This apparatus rises at high speed to the surface (27) of the water, because of its high buoyancy and low hydrodynamic drag, when it is released and the cable (8) is unwound by a winch, and then springs vertically out of the water, because of the kinetic energy acquired, for a sufficient time to permit an observation or a communication, which is transmitted to the submarine by the cable (8), and finally the apparatus is brought back into the tube (3) through the rewinding of the cable (8) onto the winch. The empennage (7) of the apparatus is preferably twisted in order to impart to the latter a movement of rotation in the direction of the arrow (28), so that the camera (15) sweeps the entire horizon.

14 Claims, 2 Drawing Figures

PROCESS AND ARRANGEMENT FOR AERIAL OBSERVATION AND/OR COMMUNICATION FOR A SUBMERGED SUBMARINE

BACKGROUND OF THE INVENTION

When a submarine is sailing submerged at shallow depth, it can extend raisable masts carrying periscopes or antennas in order to observe the surface of the sea or to communicate with a distant point; it is thus able to make observations or exchange communications within the various ranges of electromagnetic radiation propagated in the atmosphere.

The same is no longer true when the submarine is submerged at great depth, because electromagnetic radiation is propagated extremely badly through seawater. It can then only receive very low frequency radio transmissions by towing an antenna floating near the surface of the water.

In the underwater medium, as soon as the distance exceeds a few meters, observations and communications are made solely by acoustic radiation. Nevertheless, in the layer of water situated near the surface the temperature varies fairly quickly with depth, and sound rays are highly curved in a vertical plane, and for this reason, among others, acoustic transmission near the surface is very uncertain.

In such circumstances, a critical situation arises for a submarine which, while sailing submerged at a depth greater than a few tens of meters in order to avoid all risk of collision with the hulls of deep-draft ships, such as tankers, wishes to surface. In the course of the last phase of rising to the surface, before emergence, when its acoustic detection is no longer effective and it is not yet possible to use the raisable masts which would permit aerial observation, there are difficulties in detecting an unforeseeable obstacle sufficiently early, having regard to the speed of movement of the submarine and possibly that of the obstacle.

The aim of the invention is in particular to provide an aerial observation means for a submarine while it is sailing for safety reasons at a depth greater than a few tens of meters.

One solution could comprise towing a float on the surface or near the surface of the sea; this float would have to be able to support a periscope mast of a height of 5 to 10 meters in order to avoid masking by waves and to have sufficient range; the mast would have to be stabilized vertically against the action of the swell; consequently, the float would be of very large dimensions incompatible with being stowed on board a submarine.

The invention proposes another solution, which is novel and unexpected.

It is based on the fact that two or three seconds are sufficient to observe the entire surface of the sea, for example with a television camera sweeping the whole horizon.

SUMMARY OF THE INVENTION

The object of the invention is thus a process of aerial observation and/or communication (data exchange) for a submerged submarine, utilizing a floating body equipped with observation and/or communication means (data exchange means) and connected to the submarine by a retaining cable, which in addition is used for the transmission of the observation and/or communication signals between the floating body and the submarine. According to the invention, this process consists in releasing the floating body, which is initially held on board the submarine and consists of an apparatus of high buoyancy and low drag, in such a manner as to cause it to rise rapidly to the surface, pass through the surface and spring out of the water, bringing its observation and/or communication means into operation at least during the aerial phase of its trajectory and then bringing it back on board the submarine by hauling back the connecting cable.

The invention makes use of the emergence phase of a floating body released at a certain depth, which is due to the kinetic energy which it acquires during its upward movement. The duration of this emergence, although short (a few seconds), nevertheless makes it possible to carry out the desired observation or communication, particularly if the apparatus is given a structure suitable for imparting to it, during its upward movement, a rotary motion about a vertical axis which continues after it is out of the water, and if its observation and/or communication means are arranged so that they aim in a direction at right angles to that axis. This spontaneous rotation of the apparatus about its own axis achieves in a neat manner a movement of the said means which makes a panoramic sweep of the horizon, without its being necessary to provide any mechanical angular sweep device on the apparatus.

Another object of the invention is an arrangement enabling the process defined above to be put into practice. This comprises a streamlined, finned apparatus possessing great buoyancy and containing observation means, such as a television camera or a radar antenna, and/or communication means, such as a radio antenna, together with a mechanical and electrical connection cable attached to the apparatus and winding onto the drum of a motorized winch placed on board the submarine.

In a preferred embodiment, the empennage of the apparatus is shaped in such a manner as to impart to the latter, during its rise towards the surface of the water, a movement of rotation about its own axis, which is then directed vertically, while the observation and/or communication means of the apparatus aim in a direction perpendicular to this axis, in such a manner as to sweep the horizon because of this rotary movement. In addition, it is expedient to equip the apparatus with a reference gyroscope which, via the cable connecting it to the submarine, supplies the sighting bearing for the observation and/or communication means, at least during the aerial phase of its trajectory. The bearing angle can thus be accurately known, whatever the rolling movements performed by the apparatus during its upward path. In order to permit adjustment of the initial orientation of the apparatus about its axis, the apparatus may be provided with sighting means (optionally consisting of its observation means) which, when the apparatus is in the starting position on board the submarine, face a bearing graduation surrounding the apparatus and connected to the submarine.

The apparatus is advantageously stowed on board the submarine in a water-filled launching tube, which is equipped with a watertight door at its mouth and on the bottom of which is mounted the winch operating the connecting cable. This door makes it possible to limit the pressure inside the tube at great submersion depths. The tube is preferably directed obliquely, for example at 45°, and is inclined towards the stern of the submarine, whereby because of the speed of advance of the submarine the launching of the apparatus and its return into the tube are facilitated. Correct reinsertion of the apparatus into the tube can moreover be effected by providing for the connecting cable a guide pulley disposed in such a manner as to compel the cable to pass through the tube substantially along the axis of the latter. In one advantageous embodiment this pulley is carried by a floating stopper which is situated under the empennage of the apparatus in the starting position in the tube, and which rises with the apparatus, when the latter is released, and is stopped by stop means at the mouth of the tube after having moved in the latter in a purely translatory movement with the aid of guide means, consisting for example of rails disposed longitudinally on the inside wall of the tube.

The apparatus may be equipped with a detector transmitting a signal at the moment when it passes out of the water. This signal can be used to control the rewinding of the connecting cable by the winch, in such a manner as to bring the apparatus back on board the submarine.

The apparatus may in addition have a hollow construction, thus making it possible for it to be filled with a pressurized gas for the purpose of increasing its resistance to the pressure of the water.

The following description, with reference to the accompanying drawings given by way of example without limitation, will make it possible to understand clearly how the present invention can be put into practice.

DESCRIPTION OF THE PREFERRED EMBODIMENT

Figure 1:
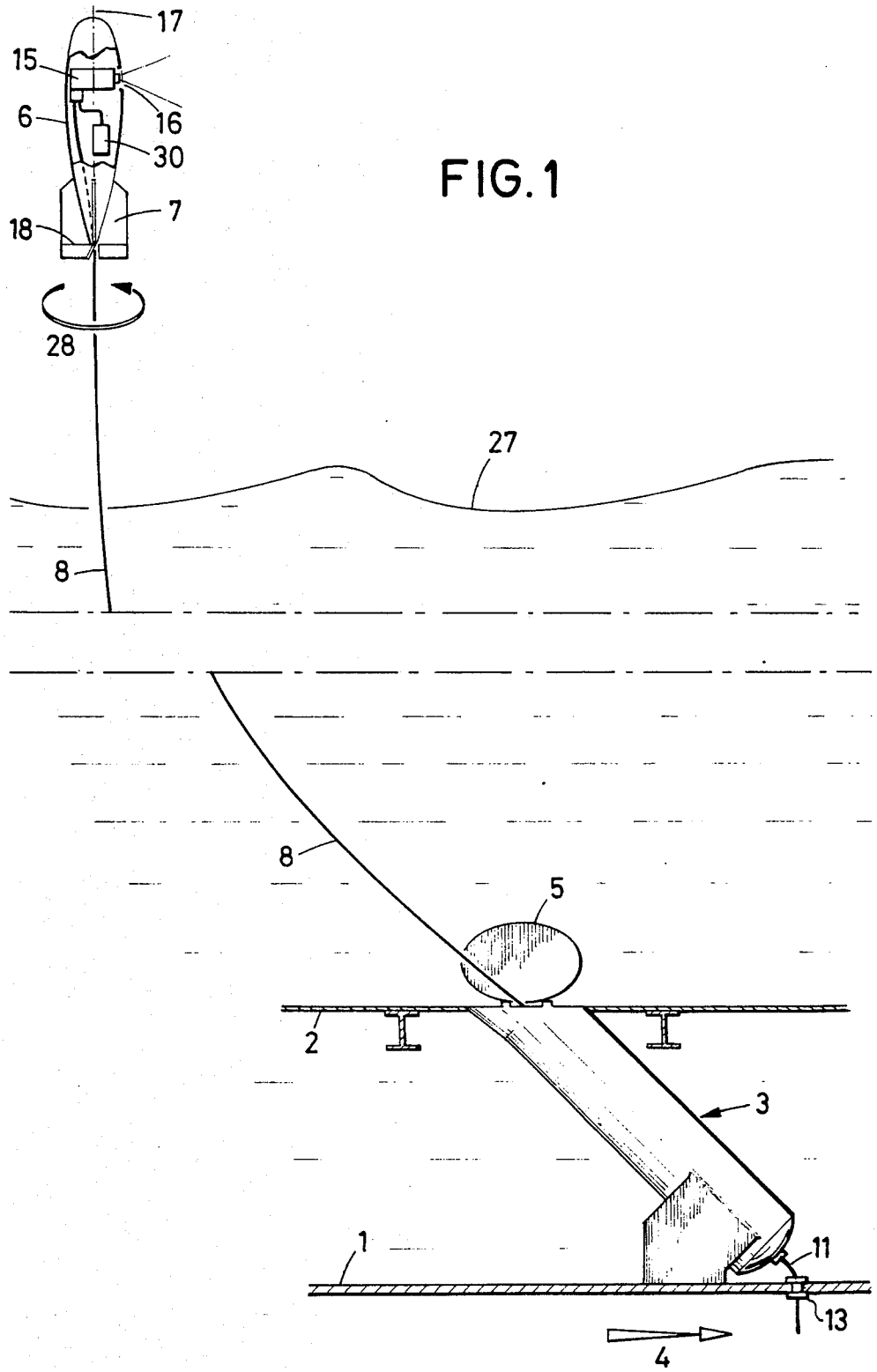
FIG. 1 shows diagrammatically an arrangement according to the invention, showing the apparatus which has left the submarine to accomplish an aerial observation mission.
Figure 2:
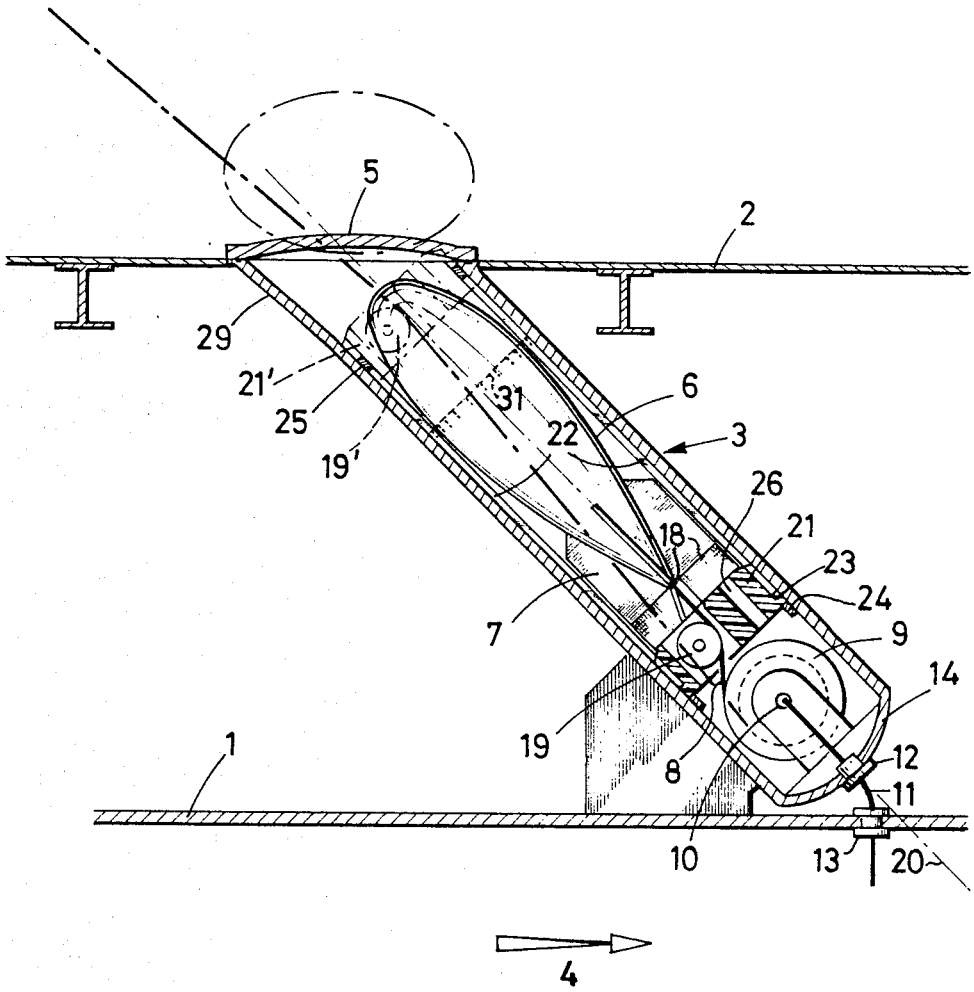
FIG. 2 is a longitudinal section to a larger scale of the launching tube of the arrangement shown in FIG. 1.

The drawings show a part of the hull 1 of a submarine, above which is disposed a superstructure plate 2 (bridge deck). Between the hull 1 and the plate 2 is disposed a launching tube 3 directed obliquely at 45° towards the stern of the submarine, which advances in the direction indicated by the arrow 4. The mouth of the tube 3 in the plate 2 is provided with a pivoting watertight door 5.

The tube 3 serves to accommodate an apparatus 6 stowed on board the submarine. This apparatus has externally the shape of a body streamlined so as to have low hydrodynamic drag, and is provided with a stabilizing empennage 7. To its rear is attached a cable 8 which is wound on the drum 9 of a motorized winch submerged at the bottom of the tube 3. This cable makes the mechanical connection between the apparatus 6 and the submarine, and also effects the transmission of electric signals via a rotating connector 10 and an electric cable 11 penetrating into the interior of the submarine through watertight bushings 12,13 disposed respectively in the bottom 14 of the tube 3 and in the hull 1 of the submarine. At the apparatus end the cable 8 is connected electrically to a television camera 15 mounted on board the apparatus 6 and directed in such a manner as to aim, through a transparent scuttle 16, in a direction at right angles to the longitudinal axis 17 of the apparatus.

The fins of the empennage 7 of the apparatus 6 are provided with folds 18 imparting to the apparatus a movement of rotation about its axis 17 when it is traveling in the water.

Inside the tube 3 the cable 8 passes over a pulley 19 which holds it substantially on the axis 20 of the tube. This pulley, which turns freely, is carried by a floating stopper 21 adapted to move in a translatory movement in the tube 3, sliding along guide rails 22 disposed on the inside wall of the tube 3 parallel to its axis 20. For this purpose the stopper 21 has a peripheral bead 23 provided with slots cooperating with the rails 22, in such a manner that the axis of rotation of the pulley 19 remains perpendicular to the vertical plane containing the axis 20 of the tube 3. The path of the stopper 21 in the tube 3 is limited at the bottom by a circular rib 24 projecting from the inside wall of the tube just above the drum 9 of the winch, and is limited at the top by another similar circular rib 25 situated at the mouth of the tube 3; these ribs cooperate with the bead 23 on the stopper 21 in order to halt the latter either near the bottom 14 of the tube 3 when the apparatus is in the tube or, at 21', near the mouth of the tube when the apparatus has left the tube. The displacements of the stopper 21 in the water filling the tube 3 are facilitated by at least one hole 26 passing from one face to the other of the stopper, in order to permit the flow of water. Similarly, the apparatus 6 can move in the tube 3 without a piston effect because of the annular gap provided between its outer surface and the inside wall of the tube 3 caused by the presence of the rails 22, the water being able to flow through this gap.

When it is desired on board the submerged submarine to observe the surface of the sea or to communicate with a distant point, the door 5 of the launching tube 3 is opened (FIG. 1). The apparatus 6, which has great buoyancy, passes out of the tube 3. The floating stopper 21 rises and follows the apparatus beneath its empennage 7, until stopped at 21' by the rib 25 at the mouth of the tube. The cable 8 unwinds as the apparatus 6 rises to the surface 27 of the sea; to prevent it hampering this rising movement, the drum 9 of the winch is then put into operation to pay out the cable 8. The apparatus picks up speed, while its empennage 7, which is slightly twisted because of the folds 18, imparts to it a movement of rotation about its axis 17, which gradually rises to the vertical position—slowly because of the position of its center of gravity considerably below its center of buoyancy and quickly through the action of its empennage 7. The apparatus then reaches the surface 27 of the sea, passes through it, and emerges from it at high speed because of the kinetic energy acquired, spinning about its axis in the direction of the arrow 28. The camera 15 then scans the entire horizon (several times because the apparatus generally turns several times above the water) during the few seconds of the duration of the aerial phase of the trajectory of the apparatus, the corresponding views being transmitted to the submarine through the cables 8 and 11. When the apparatus starts to fall back, the direction of operation of the winch is reversed, and it winds back the cable 8, which brings back the apparatus until it re-enters the tube 3. Through the action of the cable guide pulley which, at 19', compels the cable to enter the tube while centered on the axis 20 of the latter, the apparatus is corrctly presented for penetrating by its rear into the tube (whose mouth is in addition slightly widened at 29) and then for regaining in the tube its position of rest after pushing back the pulley-carrier stopper from the position 21' to the position 21. The door 5 can then be reclosed until the next mission of the apparatus.

The apparatus 6 is provided with a reference gyroscope 30, information from which, transmitted to the submarine via the cables 8 and 11, makes it possible to know the bearing corresponding to each view taken by the camera 15. For this purpose, an initial reference graduation 31 is marked circumferentially on the inside wall of the tube 3. This graduation, which is illuminated by a lamp through the scuttle 16 and is situated in the field of view of the camera when the apparatus is in the starting position inside the tube, makes it possible to determine the bearing of the sighting axis of the camera at the moment when the apparatus is launched. Information from the gyroscope 30 can be transmitted purely electrically. As an alternative the gyroscope may be associated with a compass rose the image of which is formed by the camera 15 with the aid of a suitable optical system and transmitted in video form to the submarine, together with the views of the external aerial medium. Even if it is of mediocre quality and has considerable drift, the gyroscope 30 gives accurately at every moment the bearing of the sighting axis of the camera 15 because of the very short duration of the rising movement phase of the apparatus and the aerial observation phase.

For each mission of the apparatus, since the latter makes more than one turn on its axis during its emergence phase, the submarine crew thus has a complete view of the surface of the sea, which is preferably recorded by a video recorder together with the indication of the bearing associated with each view. The crew can decide to surface in complete safety, the route of the submarine being modified if desired.

The television camera 15 can be installed vertically in the apparatus 6 instead of horizontally, a mirror or prism being provided to bring its field of view back to the horizontal when the apparatus emerges from the water. In addition, this camera may be a low-light-level camera operating at night, or an infrared camera operating in fog. It may also be replaced by a radar antenna serving the same observation function, or by a UHF antenna enabling the submarine to transmit or receive a radio signal for a few seconds.

It is expedient to give the apparatus 6 a very light structure, so that it can achieve a high speed at the end of its submerged upward movement phase. It is preferably completely hollow and composed of a watertight, resistant skin of reinforced plastics material, such as a composite glass-resin material. Its compressive strength can be increased by inflation with dry air or nitrogen to a pressure of 1 or 2 bars, which will in addition protect its equipment against corrosion and also make it possible to monitor its watertightness continuously by providing it with a pressure pickup.

The launching tube 3, which is accommodated in the superstructure of the submarine, also participates in the resistance of the apparatus 6 to the water pressure due to the submersion of the submarine. It is constantly full of water, but is kept closed by the watertight door 5 when the submarine is submerged to a greater depth than the safety submersion, that is to say a few tens of meters, so that the pressure prevailing in the tube 5 and exerted on the apparatus 6 does not exceed a few bars when the submarine is at a great depth.

The moment when the apparatus 6 emerges from the water can for example be detected by a humidity detector or a pressure pickup carried by the apparatus, its signal being transmitted to the submarine through the cable 8. A few seconds after that moment the winch changes its direction of rotation and winds back the cable 8. In order to be able to bring back the apparatus 6, the cable 8 is provided with a sheath, preferably made of the aromatic polyamide "Kevlar", which has sufficient torsional flexibility to enable the apparatus to twist the cable a few turns during its upward movement. The winch motor is preferably an electric motor rather than a hydraulic motor, so as to avoid a hull bushing additional to the bushing 13.

What is claimed is:

1. A process of aerial observation and/or communication for a submerged submarine, utilizing a floating body equipped with observation and/or communication means and connected to the submarine by a retaining cable, which in addition is used for the transmission of the observation and/or communication signals between the floating body and the submarine, which process consists in releasing the floating body, which is initially held on board the submarine and consists of an apparatus of high buoyancy and low drag, in such a manner as to cause it to rise rapidly to the surface, pass through the surface and spring out of the water, bringing its observation and/or communication means into operation at least during the aerial phase of its trajectory, imparting to the body during its upward movement, a rotary motion about a vertical axis which continues after it is out of the water, the observation and/or communication means being arranged so that they aim in a direction at right angles to the axis, and then bringing it back on board the submarine by hauling back the connecting cable.

2. A process for a submerged submarine to engage aerial data exchange using a highly buoyant floating body equipped with data exchange means and connected to the submarine over a cable for carrying data, comprising confining the highly buoyant floating body within the submerged submarine, thereafter releasing the floating body from the submerged submarine into surrounding water so that the floating body rapidly rises through the surrounding water to the surface of the surrounding water while maintaining its connection to the submerged submarine over the cable, providing the floating body with sufficient buoyancy so that it rises through the surrounding water at such a rate that it springs upwardly from the surface water into surrounding air, activating the data exchange means as soon as the body springs from the water surface for initiating data exchange, and retracting the cable for returning the floating body back to the submerged submarine.

3. A process according to claim 2, including imparting a spin to the floating body as it rises through the surrounding water and providing the floating body to have a center of buoyancy so that it assumes a vertical ascent through the surrounding water while it is spinning, whereby the floating body continues to spin after it has sprung from the water surface so that the aerial data exchange is conducted through 360° around the vertical axis.

4. A process according to claim 3, including conducting the data exchange in a direction which is perpendicular to the vertical axis.

5. An apparatus for enabling a submerged submarine to engage in aerial data exchange, comprising:

a launch tube connected to the submarine;

a floatation body disposed in said launch tube and releaseable from said launch tube, said floatation body being streamlined and being highly buoyant;

data exchange means in said floatation body for receiving or transmitting data after said floatation body has left said launch tube;

a cable connected to said floatation body and adapted for connection to the submerged submarine for maintaining communication between the submerged submarine and said floatation body and for returning said floatation body to said launch tube;

rotation means connected to said floatation body for imparting a rotation to said floatation body when it passes through water after it has been launched from said launch tube; and return means connected to said cable for returning said floatation body to said launch tube;

the buoyancy of said floatation body being selected so that when said floatation body is released from said launch tube it rises sufficiently rapidly through surrounding water so that it springs from a surface of the surrounding water to expose said data exchange means to surrounding air so as to engage in aerial data exchange.

6. An apparatus according to claim 5, including positioning said data exchange means so as to exchange data in a direction perpendicular to a vertical axis, said rotation means rotating said floatation body about a vertical axis as it ascends through water after it has been launched from said launch tube.

7. An apparatus according to claim 6, including a gyroscope in said floatation body for establishing a frame of reference for said data exchange means for aerial data exchange while said floatation body rotates about the vertical axis.

8. An apparatus according to claim 7, including a bearing graduation marked in said launch tube which is perceivable by said data exchange means for establishing a reference for data exchange.

9. An apparatus according to claim 5, wherein said launch tube includes an open end for releasing said floatation body and an openable cover covering said open end.

10. An apparatus according to claim 9, wherein said launch tube is inclined at an acute angle and rearwardly with respect to a direction of movement of the submerged submarine carrying said launch tube.

11. An apparatus according to claim 9, wherein said release means includes a wench for discharging and collecting said cable, a pulley support movably mounted in said launch tube for moving with said floatation body as said floatation body leaves said launch tube up to a point within said launch tube, and a pulley mounted on said pulley support and engaged with said cable for guiding said cable.

12. An apparatus according to claim 11, wherein said pulley support comprises a floating stopper which is buoyant, said launch tube including a stop therein for stopping ascent of said stopper when said floatation body is launched from said launch tube.

13. An apparatus according to claim 5, including detection means in said floatation body for detecting one said floatation body as sprung from the water surface, said detection means connected to said data exchange means for activating said data exchange means after said floatation body has sprung from the water surface.

14. An apparatus according to claim 5, wherein said floatation body defines an inner space and pressurized gas filling said space.

* * * * *